US006092524A

United States Patent [19]

Barnes, Sr.

[11] Patent Number: 6,092,524

[45] Date of Patent: Jul. 25, 2000

[54] MOUTHGUARD

[76] Inventor: Carl A. Barnes, Sr., 4819 Royal St., New Orleans, La. 70017

[21] Appl. No.: 09/351,613

[22] Filed: Jul. 12, 1999

Related U.S. Application Data

[63] Continuation-in-part of application No. 08/637,553, Apr. 25, 1996.

[51] Int. Cl.[7] ..... A61C 5/14

[52] U.S. Cl. ..... 128/859; 128/861

[58] Field of Search ..... 128/846, 848, 128/859–862; 433/6–8

[56] References Cited

U.S. PATENT DOCUMENTS

| | | | |
|---|---|---|---|
| 3,871,370 | 3/1975 | McDonald | 128/860 |
| 3,924,638 | 12/1975 | Mann | 128/862 |
| 4,519,386 | 5/1985 | Sullivan | 128/859 |
| 4,799,500 | 1/1989 | Newbury | 128/859 |

*Primary Examiner*—Michael A. Brown
*Attorney, Agent, or Firm*—Kenneth L Tolar

[57] ABSTRACT

A uniquely constructed mouthguard designed to minimize discomfort and speech interference associated with conventional mouthpieces includes a pair of posterior portions for encompassing the posterior teeth that are interconnected with a front wall. The front wall overlays a substantial portion of the front surface of the anterior teeth but terminates at a predetermined distance from the lower edge thereof. Accordingly, a wearer's tongue is free to engage the exposed lower edge of the anterior teeth so that the wearer can speak clearly while the device is being worn. Each posterior portion includes an inner and outer wall with the inner wall terminating at the gum line so as to minimize discomfort to the wearer.

3 Claims, 1 Drawing Sheet

MOUTHGUARD

The following substitute specification is a continuation-in-part of application Ser. No. 08/637,553 filed Apr. 25, 1996.

BACKGROUND OF THE INVENTION

The present invention relates to a uniquely configured mouth guard, particularly suitable for athletes, that is specially designed to minimize discomfort and speech interference associated with conventional athletic mouth pieces.

DESCRIPTION OF THE PRIOR ART

Athletes such as football players, boxers, and basketball players typically wear a mouthpiece on the upper teeth that redistributes the impact associated with blows to the jaw, mouth or chin. A conventional mouthpiece includes a substantially U-shaped splint constructed with a moldable plastic. The mouthpiece includes a channel defined by an interior side wall, an exterior side wall and a bottom wall. Typically, the device is preheated allowing a user to bite into the device to form a mold of the teeth within the bottom wall.

Such devices, however, have numerous disadvantages. The interior side walls typically contact the palatal region of the mouth resulting in significant discomfort and even gagging. In addition, the channel completely encompasses both the front and rear surfaces of the anterior teeth thereby interfering with speech. Accordingly, certain athletes, such as football quarterbacks, who must speak clearly when communicating signals to teammates, must repeatedly remove the mouthpiece while speaking and reinsert it which is burdensome and inconvenient. Furthermore, each of the above described disadvantages discourage some athletes from wearing mouthpieces thereby resulting in increased frequency of tooth related injuries. The present invention overcomes the above described disadvantages of conventional mouthpieces by providing a device that is designed to protect the teeth but does not interfere with speech, is comfortable to wear and minimizes concussions.

Various mouthpieces and mouthguards exist in the prior art. Most notably, U.S. Pat. No. 4,799,500 issued to Newbury relates to a method and apparatus for treatment of muscle imbalance. The apparatus includes a splint molded from plastic material to fit over the teeth of the lower jaw. The splint includes two arms molded to receive the molar teeth which is interconnected with a central bridge section. The bridge section extends behind the incisors and canine teeth of the lower jar so as to be concealed when the device is worn. The device is designed to prevent direct contact between the molar teeth of the upper and lower jaws and to reposition the molar teeth of the lower jaw relative to the upper jaw to permit movement of the lower jaw in a preferred path. The present invention is distinguishable in that it is designed for the upper teeth and includes a "bridge" that overlays a substantial portion of the front surface of the incisors but terminates at a predetermined distance from the lower edge thereof. Accordingly, the device does not interfere with a wearer's speech.

SUMMARY OF THE INVENTION

The present invention relates to a mouthguard for athletes and similar persons engaging in activity that may pose danger to the teeth. The device comprises a mouth splint including a pair of posterior portions molded to receive and overlay the posterior teeth. The posterior portions are interconnected with a front portion that overlays the incisors. The front portion is dimensioned to cover substantially all of the front surface of the incisors while leaving the lower or cutting edge of the incisors exposed. Accordingly, a wearer's tongue is free to engage the lower edge of the incisors allowing a user to speak clearly while the device is being worn. The posterior portions each include an inner and outer wall with the inner wall terminating at the gum line so as to minimize discomfort to the wearer. It is therefore an object of the present invention to provide a mouthguard that is comfortable to wear.

It is another object of the present invention to provide a mouthguard that allows a wearer to speak clearly.

It is yet another object of the present invention to provide a mouthguard that is easy and inexpensive to manufacture.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
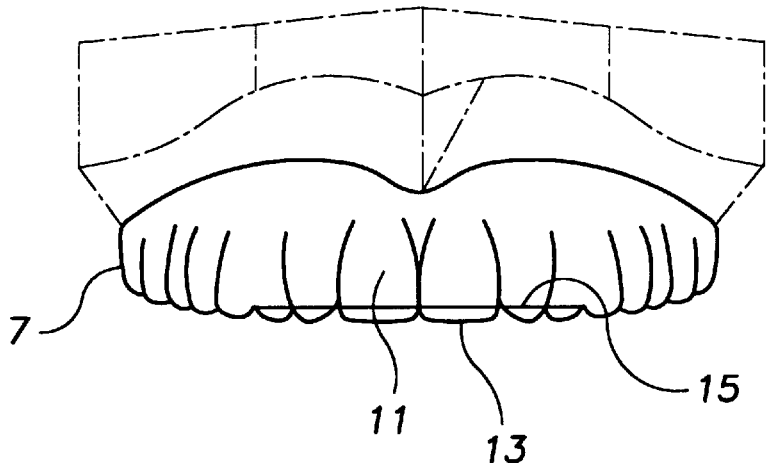
FIG. 1 is a front view of the upper teeth with the mouthguard according to the present invention mounted thereon.
Figure 2:
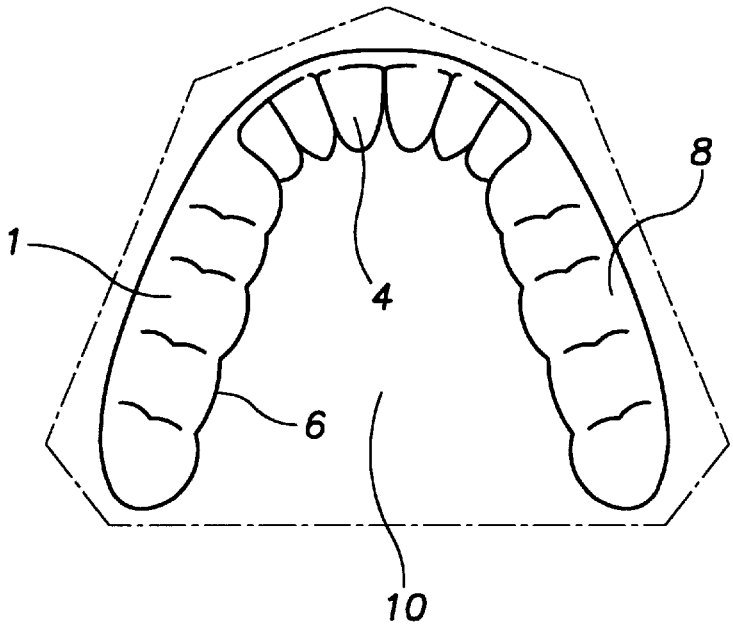
FIG. 2 is a plan view of the mouthguard mounted on the upper teeth.

Referring now to FIGS. 1 and 2, the present invention relates to a mouthguard specifically designed to be mounted on the upper teeth of a wearer. The upper teeth typically include anterior teeth 4, such as front and lateral incisors and possibly the canine teeth, and posterior teeth (not clearly pictured) such as cuspids and molars. The teeth extend into the gums at a point that is sometimes referred to as a gum line.

The mouthguard according to the present invention includes a splint comprising a pair of posterior portions 1 each specifically molded to receive and overlay the posterior teeth. Each posterior portion includes an inner wall 6, an outer wall 7 and a bottom wall 8 therebetween. Each posterior portion is molded to conform to the posterior teeth. The inner wall of each posterior portion terminates at a position proximal the junction of each posterior tooth crown and the gum, i.e. the gum line, so that the splint does not contact the palatal region 10 of the mouth thereby minimizing discomfort to the wearer. The outer wall extends a significant distance above the gum line to provide increased protection.

The posterior portions are interconnected with a front wall 11 that overlays a substantial portion of the front surface of the anterior teeth. The front wall terminates at a bottom edge 15 that is spaced a predetermined distance from the lower edge 13 of the anterior teeth, however, so that the lower edge 13 is exposed. The wearer's tongue is then free to contact the exposed lower edge so that the splint does not interfere with speech.

The above described device is preferably constructed with a resilient conformable thermoplastic material such as that manufactured under the trademark ELVAX™ or any other similar equivalent. A mold is made of the wearer's upper teeth so that the mouthpiece according to the present invention may be formed and molded according thereto and according to the details of construction enumerated above. When the mouth piece is formed according to a mold of the upper teeth, indentions are formed on the inner surface of the front wall and on the upper surfaces of the bottom wall that subsequently accommodate the wearer's teeth.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A mouthguard for securing to the upper teeth of a wearer, the upper teeth including anterior teeth, having a front surface and a lower edge, and two sets of posterior teeth, each posterior tooth having a crown portion that terminates at a gum line, said mouthguard comprising:

a pair of posterior portions, each molded to conform to and surround the posterior teeth;

a front wall interconnecting said posterior portions, said front wall molded to overlay the front surface of said anterior teeth, said front wall having a bottom edge spaced a predetermined distance from the lower edge of said anterior teeth whereby said lower edge is free to engage a wearer's tongue during speech.

2. A mouthguard according to claim 1 wherein each of said posterior portions include an inner wall, an outer wall and a bottom wall, the inner wall terminating at the gum line so as to minimize discomfort to the wearer.

3. A mouthguard according to claim 2 wherein the front wall includes an interior surface having a plurality of preformed indentions premolded to conform to said anterior teeth.

* * * * *